United States Patent [19]

de Polo

[11] 4,259,974

[45] Apr. 7, 1981

[54] UMBRELLA

[76] Inventor: Harry R. de Polo, 480 Park Ave., New York, N.Y. 10022

[21] Appl. No.: 78,815

[22] Filed: Sep. 25, 1979

Related U.S. Application Data

[63] Continuation-in-part of Ser. No. 896,572, Apr. 14, 1979, abandoned, which is a continuation-in-part of Ser. No. 796,439, May 12, 1977, Pat. No. 4,084,600.

[51] Int. Cl.[3] ..... A45B 25/14

[52] U.S. Cl. ..... 135/24; 135/26

[58] Field of Search ..... 135/20, 25 R, 25 A, 135/26, 34, 24

[56] References Cited

U.S. PATENT DOCUMENTS

| | | | |
|---|---|---|---|
| 1,666,692 | 4/1928 | Epstein | 135/25 R |
| 3,003,508 | 10/1961 | Bremshey | 135/24 X |
| 3,429,320 | 2/1969 | Edelkind | 135/34 |
| 3,534,752 | 10/1970 | Vanzini | 135/20 R |
| 3,709,238 | 1/1973 | Leopoldi et al. | 135/20 R |
| 3,844,301 | 10/1974 | Harrell | 135/20 R |
| 4,084,600 | 4/1978 | de Polo | 135/20 R |

FOREIGN PATENT DOCUMENTS

| | | | |
|---|---|---|---|
| 570251 | 2/1959 | Canada | 135/24 |
| 1194108 | 6/1965 | Fed. Rep. of Germany | 135/24 |
| 2309223 | 8/1974 | Fed. Rep. of Germany | 135/24 |
| 1217781 | 12/1959 | France | 135/24 |

*Primary Examiner*—J. Karl Bell

*Attorney, Agent, or Firm*—Robert E. Burns; Emmanuel J. Lobato; Bruce L. Adams

[57] ABSTRACT

The inner ends of cover-supporting ribs of an umbrella are pivotally connected to a rib carrier which is longitudinally slidable in a hollow shaft by means of a projection extending out through a longitudinal slot in the shaft. The rib carrier is slidable between a closed position in which the rib carrier is near the lower end of the shaft and the rib members together with the cover are in the shaft and an open position in which the rib carrier is at the upper end of the shaft and the rib members radiate out from the rib carrier so as to support the cover. Each of the ribs comprises inner and outer tubular sections which are telescopically slidable one in the other. When the umbrella is in open position, the telescopic ribs are extended so as to support a larger cover. When the umbrella is in closed condition, the telescopic ribs are contracted so as to be received in a shorter shaft. The ribs are biased to extended position by an internal spring and latch means is provided for releasably holding the ribs in contracted condition. A handle portion which is telescopically received in the lower end portion of the shaft releases the retaining latches of the ribs so that the ribs are extended when the handle portion is pulled out of the shaft to an extended position thereby lengthening the shaft. The cover is a single piece of two-way stretch material having inwardly opening pockets at its periphery to receive outer ends of the ribs. The cover is stretched when the ribs are in extended open position and contracts with the ribs when the ribs are contracted.

23 Claims, 21 Drawing Figures

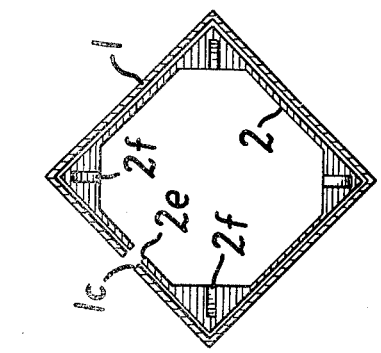
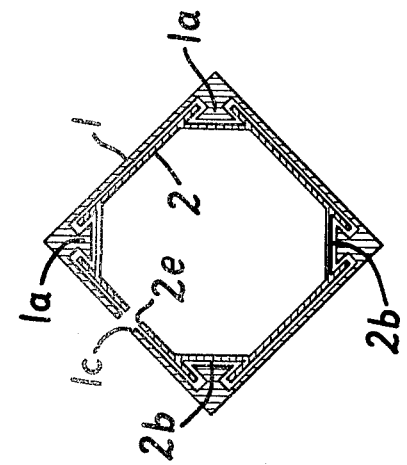
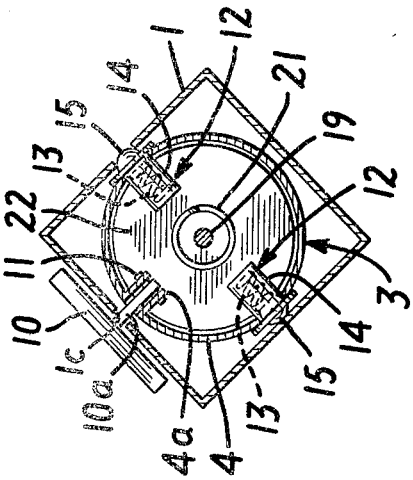
FIG. 7
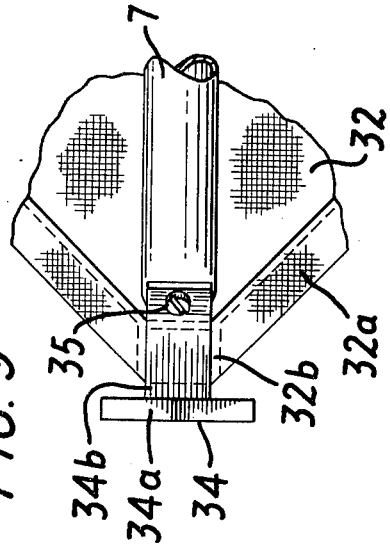
FIG. 9
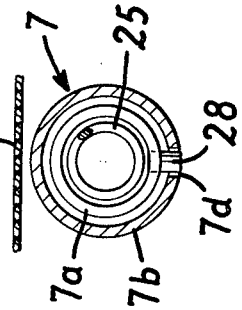
FIG. 12
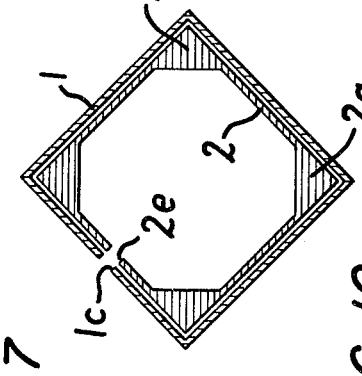
FIG. 10
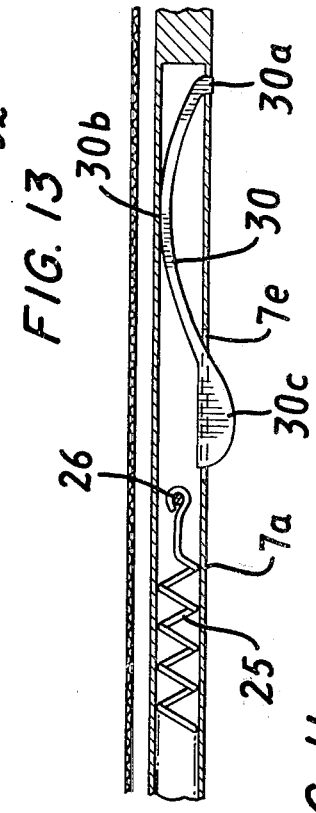
FIG. 13
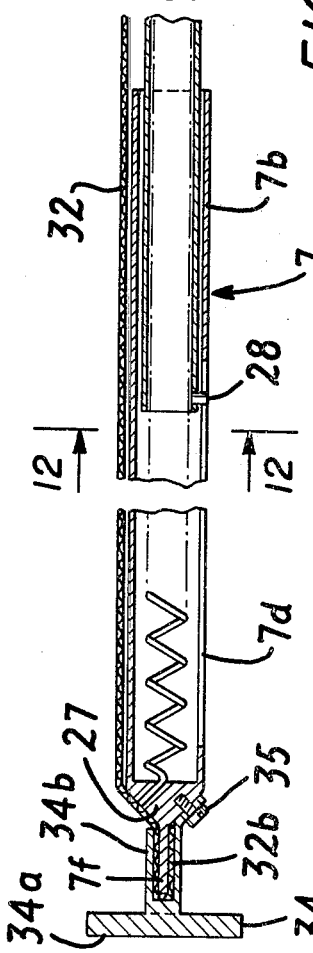
FIG. 11

UMBRELLA

REFERENCE TO EARLIER APPLICATION

The present application is a continuation-in-part of application Ser. No. 896,572 filed Apr. 14, 1979 now abandoned which is a continuation-in-part of application Ser. No. 796,439 filed May 12, 1977 now U.S. Pat. No. 4,084,600.

FIELD OF INVENTION

The present invention relates to umbrellas and particularly to umbrellas which are self-contained so that no separate case or cover is required. The term "umbrella" is herein used in a broad sense to include umbrellas, parasols, sun shades, etc. of all sizes.

BACKGROUND OF THE INVENTION

In a conventional umbrella the upper ends of ribs are pivotally connected to the upper end of a shaft and the outer ends of stays or struts are pivotally connected to the ribs intermediate their length while the inner ends are pivotally connected to a sleeve which is slidable on the shaft between a closed position in which the ribs and stays lie alongside the shaft and an open position in which the stays support the ribs in extended position. The ribs are usually flexible and the cover is made-up of a number of sector-shaped portions corresponding to the number of ribs and is fashioned so that the ribs are bowed when in open position. When the umbrella is in closed position, the cover lies in loose folds around the shaft. In order to make the umbrella look somewhat neater when closed, a small strap is attached to the cover near its periphery so that the folds of the cover can be wrapped around the shaft and ribs and secured by the strap.

It has also been proposed to connect the inner ends of ribs of an umbrella pivotally to the upper end of a rod which is longitudinally movable in a tube. The inner ends of stays are pivotally connected to a slide which is longitudinally slidable on the rod and urged downwardly by a spring. The rod is moved longitudinally in the tube by means of an external sleeve connected to the rod by a bridge extending through a slot in the tube. When the rod is moved upwardly so that it projects above the tube, the stays support the ribs in extended position much as in a conventional umbrella. When the rod is moved downwardly to the lower end of the tube, the stays, ribs and cover are retracted into the tube. While of neater appearance in closed position than a conventional umbrella, the construction is somewhat complex so that it is more expensive to construct and less dependable in its operation. Moreover, in open position it suffers from the same defect as a conventional umbrella in that it can be turned inside out by the wind.

In U.S. Pat. No. 4,084,600 there is disclosed an umbrella comprising an elongated tubular shaft having upper and lower ends and a longitudinally extending slot. A rib carrier is longitudinally movable in the shaft by means of a handle which extends out through the slot. The upper end portion of the rib carrier is slotted to receive and guide inner end portions of ribs which are pivotally connected to the carrier. By means of the externally projecting handle, the rib carrier is movable longitudinally in the shaft between a closed position in which the rib carrier is near the lower end of the shaft and the ribs are in the shaft and an open position in which the rib carrier is at the upper end of the shaft and the rib members radiate out from the rib carrier and are approximately normal to the shaft. A flexible fabric cover, which is preferably formed of two-way stretch fabric, is secured at its center to the rib carrier and at its periphery to the outer ends of the rib members. In order to be wholly received in the shaft when the umbrella is in closed condition, the ribs have a length slightly shorter than the length of the shaft.

SUMMARY OF THE INVENTION

It is an object of the present invention to provide an improvement of the umbrella disclosed in U.S. Pat. No. 4,084,600 in that the ribs are telescopic and are spring biased so that when the umbrella is in open condition, with the rib carrier at the upper end of the shaft, the ribs are extended to a length greater than the length of the shaft so as to support a larger cover. When the umbrella is in closed condition with the rib carrier near the lower end of the shaft, the telescopic ribs are contracted so as to be received wholly inside the shaft. Catch means are provided for releasably retaining the ribs in contracted condition. In one embodiment of the invention, spring means is provided for automatically propelling the rib carrier from closed position to open position when a catch is released, thereby opening the umbrella.

The shaft of the umbrella is also telescopic in that it is provided at its lower end with a handle portion that is telescopically movable between a closed position in which it is substantially received inside the shaft and an extended position in which it constitutes a downward extension of the shaft. The handle cooperates with the catch means of the ribs so that when the handle is pulled out of its extended position it releases the catches of the ribs whereupon the ribs are automatically extended by spring action.

The cover of the umbrella is of two-way stretch material having a two-way stretch of at least 20% and preferably 25% to 50% with 100% recovery. The cover is preferably of one-piece construction in contrast with the panel construction of the cover of a conventional umbrella and is preferably of such size that its crosswise dimension corresponds approximately to, or is less than twice, the length of the ribs when in contracted condition. When the ribs are extended, the cover stretches to accommodate the greater length of the ribs.

A feature of the two-way stretch cover is that inwardly opening pockets at the periphery of the cover removably receive tip portions of the ribs. This is the sole connection of the cover to the frame of the umbrella except for a removable fastening at the center of the cover. When the center fastening is removed, the stretch of the fabric permits the pockets at the periphery of the cover to be slipped off of the ends of the ribs so that the cover is user-removable and user-replacable. This permits convenient replacement of worn or damaged covers and also the convenient interchanging of covers of different color or pattern. This feature of the invention is applicable to umbrellas of other frame construction.

BRIEF DESCRIPTION OF DRAWINGS

The nature, objects and advantages of the invention will be more fully understood from the following description of a preferred embodiment shown by way of example in the accompanying drawings in which:

FIGS. 7, 8, 9 and 10 are cross sections taken respectively on the lines 7—7, 8—8, 9—9 and 10—10 in FIG. 1, FIG. 11 is a longitudinal section of one rib shown in extended condition, FIG. 12 is a cross section of a rib taken on the line 12—12 in FIG. 11, FIG. 13 is a view from below of an outer portion of a rib and adjacent portion of the cover.

DESCRIPTION OF PREFERRED EMBODIMENT

Figures 1, 2:
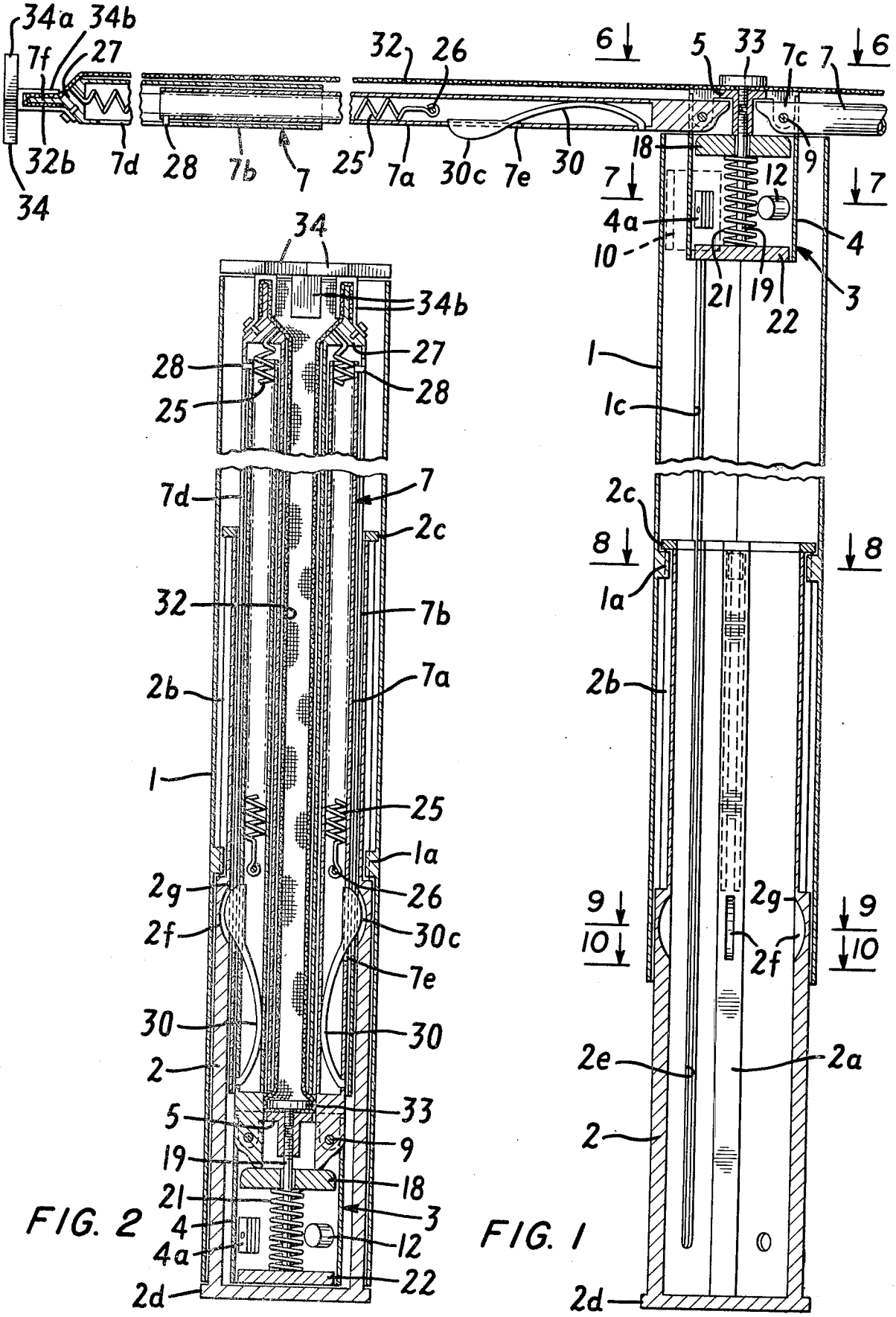
FIG. 1 is a partial vertical section of an umbrella in accordance with the present invention shown in open position.
FIG. 2 is a vertical section of the umbrella shown in closed condition.

As illustrated by way of example in the drawings, the umbrella comprises a tubular shaft 1 which serves not only as a handle for the umbrella but also as an enclosure when the umbrella is in closed position. While the shaft 1 may be of circular cross sectional shape, it is preferably polygonal with four to eight sides. For ordinary street use the shaft 1 is preferably about 12 to 18 inches long and has a cross section dimension of about 1¼ to 2 inches. By way of example, the shaft may be 15 inches long and 1½ inches square in cross section. However, in umbrellas for other purposes, the shaft 1 may be smaller or larger. For example, it may be larger for a beach umbrella or an umbrella used as a canopy, for example over an outdoor table. While the shaft can, if desired, be made of lightweight metal tubing, for example aluminum or magnesium, it is preferably made of plastic tubing which can be provided in many attractive colors.

A shaft extension or handle portion 2 is telescopically received in a lower portion of the shaft 1. The outside cross sectional size and shape of the handle portion 2 corresponds to the inside size and shape of the shaft 1 so that the handle portion 2 is freely slidable in the shaft 1. However, as seen in FIGS. 8–10, corner portions of the handle portion 2 are filled in to provide thickened corner portions 2*a* and for a portion of its length the handle portion 2 is provided at its corners with guide grooves 2*b* (FIGS. 1, 2 and 8) to receive guide portions 1*a* provided in the corners of the shaft 1. The guide portions 1*a* not only serve to guide the handle portion 2 but also engage a stop portion 2*c* at the upper end of the handle portion to limit the extent the handle portion can be pulled out of the shaft 1. To permit assembly of the parts the stop portion 2*c* is affixed to the handle portion 2, for example by ultrasonic welding after the handle portion 2 has been inserted in the shaft 1. An enlarged portion 2*d* at the lower end of the handle portion conforms in size and shape to the outside cross section of the shaft 1. The handle portion 2 is movable longitudinally of the shaft 1 from the extended position shown in FIG. 1 to the closed position shown in FIG. 2.

Figure 3:
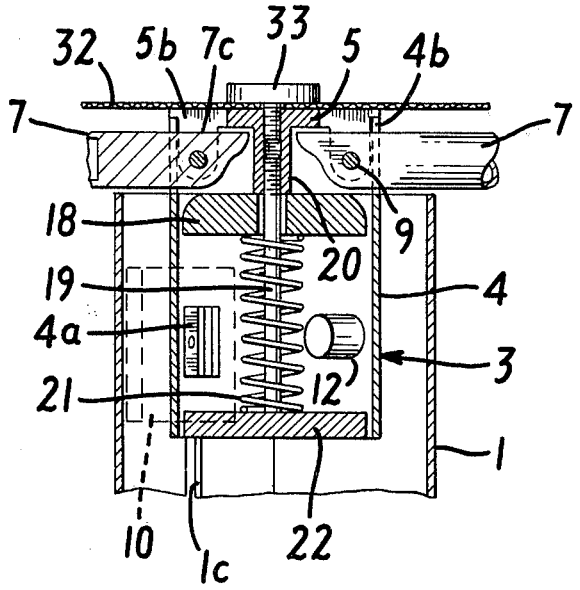
FIG. 3 is a sectional view corresponding to a portion of FIG. 1 but shown on an enlarged scale.
Figure 4:
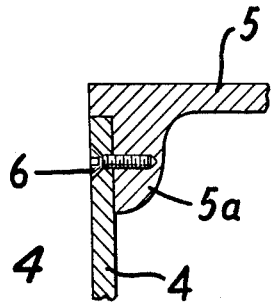
FIGS. 4 and 5 are partial sectional views showing details of construction.
Figure 5:
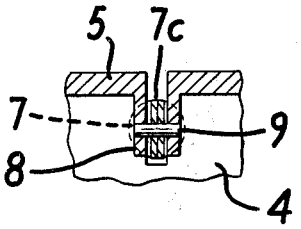

Inside the tubular shaft 1 there is a rib carrier 3 which is shown as comprising a tubular sleeve 4 to the upper end of which is affixed a cap 5. The sleeve 4 is of a size and shape to be received in the handle portion 2. While it can, if desired, have a cross sectional shape corresponding to the inside cross section of the handle portion 2 (FIG. 10), it is shown as being of circular cross section as seen in FIG. 7. The cap 5 is removably affixed to the upper end of the sleeve 4, for example, by means of screws 6 which extend through holes in the sleeves 4 and screw into downwardly extending bosses 5*a* on the lower side of the cap 5 as seen in FIG. 4. The cap 5 is provided with radial slots 5*b* which are aligned with axial slots 4*b* in the upper end portion of the sleeve 4 to receive the inner ends of ribs 7. Four such ribs are shown in the drawing. While the number of ribs can be varied as desired, the number is usually between 4 and 8. As will be seen in FIG. 6, the ribs are located at the corners of the square shaft 1. As will be pointed out below, this is a desirable arrangement. Hence if the shaft 1 has a polygonal cross section other than square, the number of ribs preferably corresponds to the number of sides—and hence the number of corner—of the shaft. The ribs 7 are preferably tubular, for example, of light metal or plastic material. As seen in FIGS. 1, 11 and 12 each of the ribs comprises an inner section 7*a* and an outer section 7*b*, which are telescopically slidable relative to one another. An inner end portion 7*c* of each rib is flattened so as to extend through slots 4*b* and 5*b* of the rib carrier and be received between space tabs 8 (FIG. 5), which are formed on the underside of the cap 5. A pin 9 extending through aligned holes in the tabs 8 and the flattened inner end portions 7*c* of the rib 7 pivotally connects each of the ribs 7 to the rib carrier 3. In their pivotal movement between open position, as shown in FIGS. 1 and 3, and closed position, as shown in FIG 2, the ribs 7 are guided by the parallel tabs 8 and by the aligned slots 4*b* and 5*b* in the sleeve 4 and cap 5 of the rib carrier 3.

The rib carrier 3 is movable longitudinally in the shaft 1 by means of a knob 10 which has a flat bridge portion 10*a* and extends through a longitudinal slot 1*c* in the shaft 1 and is secured to inwardly projecting tabs 4*a* of the sleeve 4 of the rib carrier by means of a pin 11. The handle portion 2 which forms a telescopically extension of the shaft 1 is provided with a longitudinal slot 2*e* which coincides with the longitudinal slot 1*c* in the shaft 1. By means of the knob 10, the rib carrier 3 is movable longitudinally of the tubular shaft 1 and handle portion 2 between an opening position in which the rib carrier is at the upper end of the tubular shaft 1 and the ribs 7 radiate from the rib carrier (FIG. 1) and a closed position in which the rib carrier 3 is at the lower end of the tubular shaft 1 and the ribs 7 are inside the shaft (FIG. 2). Latch means is provided for releasably retaining the rib carrier 3 in opened and closed positions. Such latch means is shown by way of example in the drawings as comprising a bullet-type latch 12 in which a compression spring 13 in a barrel 14 urges a latch member 15 into an aligned hole in the shaft 1 when the rib carrier is in open position and into aligned holes in the handle portion 2 and shaft 1 when the rib carrier is in closed position. The latch member 15 may be in the form of a small plunger with a rounded nose or in the form of a ball as shown by way of example in the drawings. For the purpose of alignment of the rib carrier 3 in the shaft 1, a second latch means 12 is preferably provided at the opposite side of the rib carrier as seen in FIG. 7.

Figure 6:
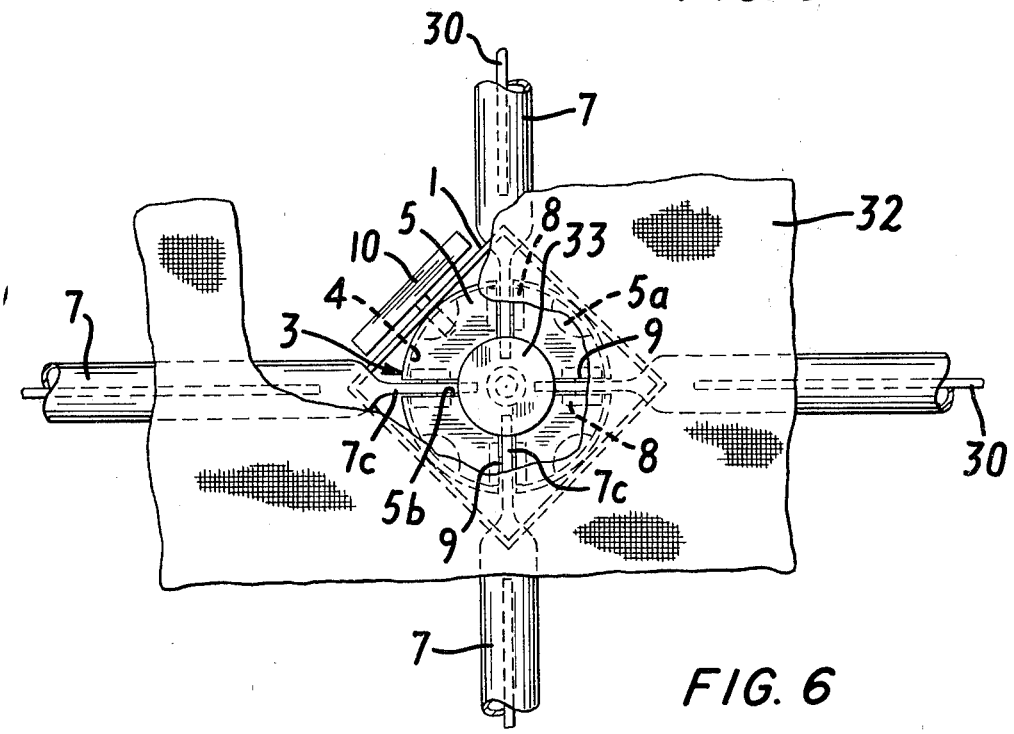
FIG. 6 is a partial plan view taken from the line 6—6 in FIG. 1 with portions of the cover broken away to show underlying structure.

The rib carrier 3 is further provided with means for holding the ribs 7 approximately perpendicular to the tubular shaft 1 when the umbrella is in open position as illustrated in FIG. 1. The locking means is shown by way of example in FIGS. 1–3 as comprising a locking plate 18 which is slidable on a rod 19, the upper end of which is threaded and screwed into a tapped central boss 20 extending downwardly on the underside of the cap 5 of the rib carrier. A compression spring 21 surrounds the rod 19 and acts between the pressure plate 18 and a disc 22 fixed to the lower end of the rod 19 so as to urge the pressure plate upwardly. The upper surface of the pressure plate 18 engages inner ends of the ribs 7 inwardly of the pivots 9 so as to restrain the ribs from swinging upwardly. Downward movement of the ribs is prevented by engagement with the bottoms of the slots **4*b* in the sleeve 4 and with the upper edge of the tubular shaft 1. By reason of the ribs being located at the corners of the tubular shaft 1, the support provided by the upper edge of the shaft is farther from the pivot pin 9 as seen in FIG. 6 so as to provide a longer lever arm for supporting the rib. Moreover, if the ribs were to swing downwardly beyond the position shown in FIG. 3, the inner ends of the ribs would engage the underside of the cap 5 inwardly of the slots 5*b*** thus further limiting downward movement of the ribs.

The pressure with which the locking plate 18 is pressed against the inner end portions of the ribs 7 is determined by the spring constant of the spring 21 and can be adjusted by rotation of disc 22 and hence rod 19 so as to screw the threaded upper end of the rod a greater or lesser distance into the tapped central boss 20 of the cap 5. While the disc 22 is shown as having a diameter almost equal to the inner diameter of the sleeve 4 so as to provide lateral support for the lower end of the rod 19, it can be made smaller, if desired, and may have a hexagonal or other non-circular shape to facilitate its rotation.

Each of the ribs 7 is biased to an extended condition by a spring 25 which is inside the rib and extends almost the whole length of the rib. The inner end of the spring 25 is secured to the inner section **7*a* of the rib by a transverse pin 26 which extends through an eye formed at the inner end of the spring. The outer end of the spring is affixed, for example by welding or adhesive, to an insert 27 in the outer end of the outer rib section 7*b*. Outward movement of the outer rib section 7*b* is limited by a stud or pin 28 on the inner rib section 7*a* which projects into a longitudinal slot 7*d* in the outer rib section 7*b* as seen in FIG. 11. Engagement of the stud 28 in the slot 7*d*** also serves to prevent relative rotation of the inner and outer rib section.

Catch means is provided for releasably holding each of the ribs in contracted condition. Such catch means is shown by way of example in FIGS. 1, 2 and 3 as comprising a bowed leaf spring 30 located in an inner end portion of the inner section **7*a* of the rib. An inner end 30*a* of the leaf spring is received in a small hole in the wall of the rib, an intermediate portion 30*b* bears against the opposite side of the rib and a curved detent portion 30*c* extends out through a slot 7*e* in the inner section 7*a* of the rib. When the outer section 7*b* of the rib is pushed all the way in as in FIG. 2, the detent portion 30*c* of the spring catch 30 engages in the slot 7*d* of the outer rib section 7*b*** so as to hold the rib in contracted condition.

Figure 14:
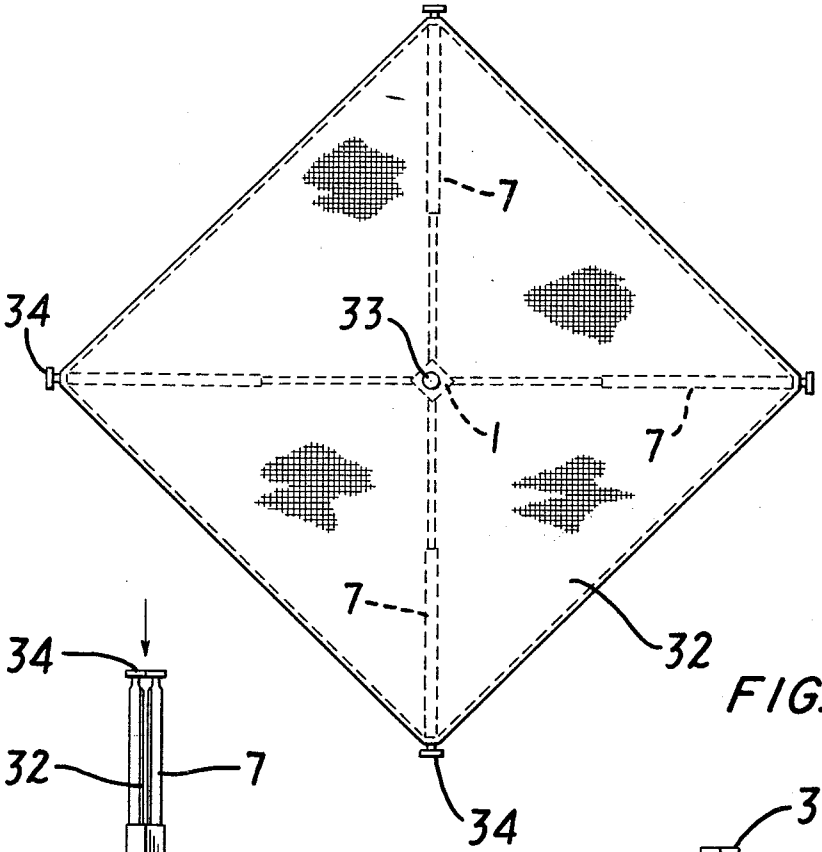
FIG. 14 is a smaller scale top plan view of the umbrella shown in open position.

The umbrella further comprises a cover 32 of two-way stretch material. The material of the cover may be knitted, woven or unwoven fabric or it may be thin sheet material formed of elastomeric material such as rubber or plastic. The material of the cover should have a two-way stretch of at least 20% and preferably at least 25% to 50% with 100% recovery after stretching. Advantageously the stretch is at least 100% with 100% recovery. In order to provide sufficient stretchability with full recovery, the cover 32 may, for example, be knit or woven with spandex yarn and suitably waterproofed. The cover is preferably of one-piece construction. When the umbrella has four ribs, the cover is square as seen in FIG. 14. If a larger number of ribs are used, the cover will be polygonal with the number of sides corresponding to the number of ribs. At its periphery the cover is provided with a hem **32*a* and with inwardly opening pockets 32*b* which receive flattened tip portions 7*f* of the ribs 7 (FIGS. 11 and 13). At its center the cover 32 is removably secured to the rib carrier 3 by a large headed screw 33 which screws into a tapped central hole of the cap 5 of the rib carrier. At the end of each rib there is a knob 34 having a square head 34*a* and a forked portion 34*b* which slips over the flattened tip of the rib as seen in FIGS. 1 and 11 and is secured by a small screw 35 which is screwed into the insert 27 at the outer end of the rib. The cover 32 can be readily removed merely by removing the knob 34 and central screw 33 whereupon the cover by reason of its elasticity can be stretched to disengage the pockets 32*b*** from the tips of the ribs. Thus, the cover can be removed by a user, for example, for washing the cover, replacing a worn or damaged cover, or replacing a cover of one color or design with a different cover.

Figure 15:
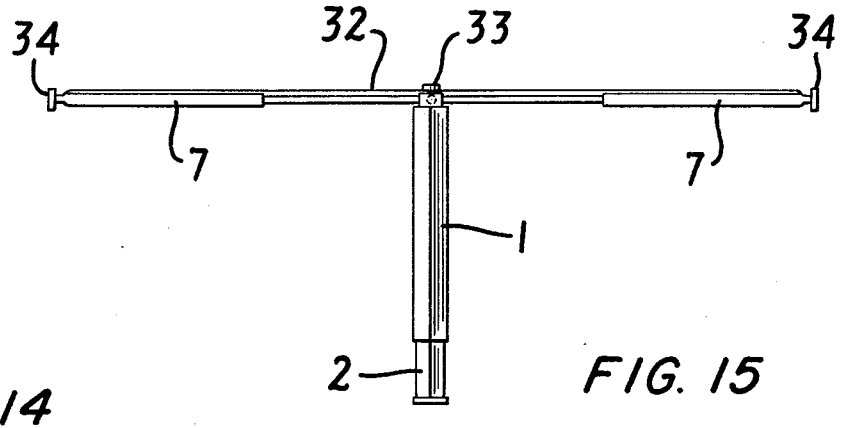
FIG. 15 is a side view of the umbrella shown open.

When the cover is in open position, as shown in FIGS. 1, 14 and 15, the rib carrier 3 is at the upper end of the tubular shaft 1 and the ribs 7 radiate from the rib carrier and are approximately normal to the shaft to support the cover 32. The ribs 7 are in extended condition and thereby hold the cover 32 stretched and taut. The cover 32 is sufficiently stretchable and the springs 25 are sufficiently strong to be able to stretch the fabric to the full extent of the telescopic ribs. The telescopic handle 2 extends downwardly from the tubular shaft 1 to the extent permitted by engagement of the upper end portion **2*c* with the guides 1*a* as seen in FIG. 1**.

Figure 17:
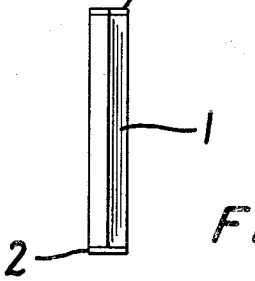
FIG. 17 is a side view of the umbrella shown in fully closed condition.
Figure 16:
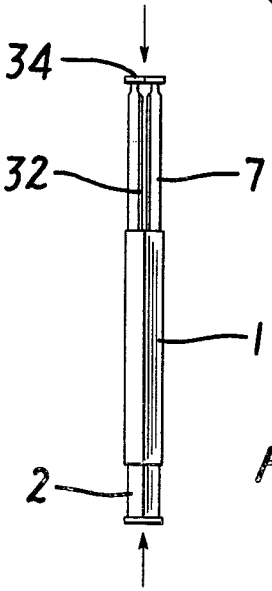
FIG. 16 is a side view of the umbrella shown in partially closed condition.

When it is desired to close the umbrella, the rib carrier 3 is moved downwardly in the shaft 1 by means of the knob 10. Engagement of the upper end edge of the tubular shaft 1 with the ribs 7 outwardly of the pivots 9 cause the ribs to swing upwardly about their pivots. The inner end edges of the flattened inner portions **7*c* of the ribs are contoured so that as the ribs 7 swing upwardly, the contoured edges cam the locking plate 18 downwardly against the bias of the spring 21. As downward movement of the rib carrier 3 continues, the ribs 7 swing upwardly to a position approximately parallel to one another and move downwardly into the shaft 1. By reason of its central portion being secured to the rib carrier 3 by the screw 33, the cover moves down into the shaft 1 with the rib carrier and ribs. When the rib carrier reaches the lower end of the shaft 1, the ribs 7 extend above the upper end of the shaft as shown in FIG. 16 by reason of the ribs still being in extended condition and thus longer than the shaft. The handle portion 2 is also in extended position as shown in FIG. 16. The ribs are then pushed down into the shaft 1 and the handle portion 2 is pushed up into the shaft by applying forces in the directions indicated by the arrows in FIG. 16. The umbrella is thus brought to fully closed condition as shown in FIGS. 2 and 17. In this condition, the spring catches 30 engage in slots 7***d* of the outer rib sections to hold the telescopic ribs in contracted condition. Morever, the spring catches 30 also engage in recesses 2*f* in the handle portion 2 to hold the handle portion in retracted position. The handle portion 2 is also held in its inner position by engagement of latch 12 with aligned holes in the handle portion 2 and shaft 1. The fabric cover has sufficient elasticity that as the telescopic ribs are contracted, the cover contracts with them thereby avoiding bulk of the cover in the tubular shaft 1. With a cover made of fabric having a two-way stretch of 20%, the area of the fabric in relaxed condition is less than 70% of the area of the cover when the ribs are in open position and the cover is thereby held in stretched condition. With a cover made of fabric having a greater two-way stretch, the area of the cover in relaxed condition is correspondingly less. Thus with a fabric having a two-way stretch of 50%, the cover has an area in relaxed condition which is less than half the area of the cover on the umbrella when the ribs are in open position.

Figure 18:
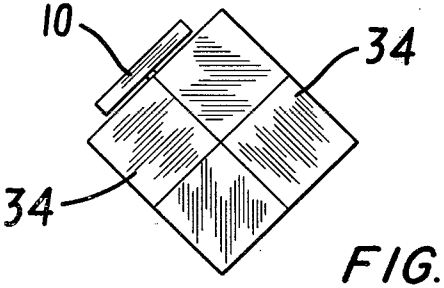
FIG. 18 is a top plan view on a larger scale of the umbrella in closed condition.

The knobs 34 on the tips of the ribs are of such size and shape and are oriented in such manner that when the umbrella is in closed position, the knobs together form a closure for the upper end of the shaft 1 as seen in FIGS. 2 and 18. Thus with four ribs the knobs 34 are square. With a larger number of ribs the knobs at the tips of the ribs would be of appropriate shape to form a closure as described.

When it is desired to open the umbrella, the handle portion 2 is pulled downwardly by means of the projecting portion 2*d* to the position shown in FIG. 1. As the handle portion 2 is pulled downwardly, portions 2*g* above the recesses 2*f* engage the spring catches 30 to push them inwardly and thereby release the outer sections 7*b* of the ribs. The springs 25 thereupon move the outer sections of the ribs 7 upwardly to the position shown in FIG. 16. The rib carrier 3 is then moved upwardly in the shaft 1 by means of the knob 10. As the rib carrier reaches the limit of its upward movement, the ribs 7 swing out to horizontal position as shown in FIG. 1 and are held in such position by the locking plate 18 as described above.

The umbrella construction in accordance with the present invention is advantageous in that it can be made almost entirely of plastic. Thus the shaft 1 and sleeve 4 of the rib carrier can be formed of plastic tubing. The ribs 7 are also conveniently formed of plastic tubing which may have a diameter of, for example, $\frac{1}{4}$ inch to $\frac{1}{2}$ inch depending on the size of the umbrella. Other portions of the umbrella such as the handle portion 2, locking plate 18 and disc 22 with its rod 19 can be conveniently molded of plastic.

While the one-piece two-way stretch cover is particularly advantageous for use with a telescopic umbrella frame as herein disclosed, it is also applicable to other frame constructions. Thus, in contrast with the conventional umbrella cover made-up of a considerable number of sector-shaped pieces which must be sewn together, the cover in accordance with the present invention consists of a single piece of two-way stretch material. This represents a considerable economy in cutting and sewing conventional umbrella covers. Moreover, as described above the umbrella cover in accordance with the present invention can easily and quickly be removed and replaced by the user thereby saving the expense of umbrella repairs and moreover affording the possibility of interchangeably using covers of different color or pattern for example to match a ensemble that the user is wearing.

Figure 19:
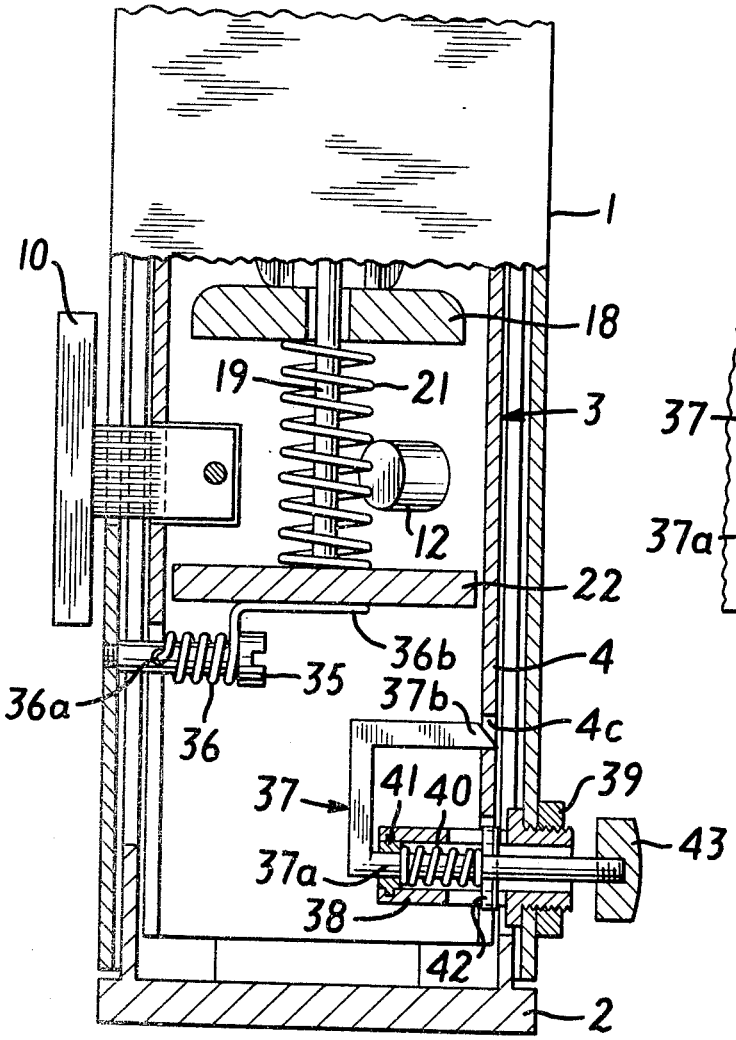
FIG. 19 is an enlarged view of the lower end of the shaft, partly in section showing a modification.

In FIG. 19 there is shown an embodiment of the invention in which means is provided for automatically opening the umbrella upon the release of a catch. FIG. 19 is a partial vertical section corresponding in general to the lower portion of FIG. 2 except that the section is not taken on a diagonal of the square shaft but in a plane indicated by the section lines 19—19 in FIG. 21. In the embodiment of FIG. 19 the shaft 1, handle portion 2 and tubular sleeve 4 are extended down below the disc 22 of the carrier 3. A stud 35 screwed into a tapped hole in the downwardly extended portion of the shaft 1 extends inwardly and carries a coil spring 36 one end 36*a* of which is anchored in a hole in the stud while the other end 36*b* comprises an arm that engages the lower side of the disc 22 when the carrier is in its lower position as shown in FIG. 19. The spring 36 thereby exerts a force on the disc 22 tending to move the carrier 3 upwardly. However, when the umbrella is closed, the carrier 3 is held in its lower position by a catch 37 which comprises a U-shaped member, one leg 37*a* of which is slidable in a barrel 38 which is secured in an opening in the shaft 1 by a nut 39. A compression spring 40 in the barrel 38 acts between a snap ring 41 at the inner end of the barrel and a cross bar 42 on the leg 37*a* of the catch to bias the catch toward the right as viewed in FIG. 19. The cross bar 42 slides in diametrically opposite slots in the barrel 38 to prevent the catch member from turning. An inclined nose 37*b* of the catch member is engageable in an opening 4*c* in the tubular sleeve 4 of the carrier 3 to retain the carrier in its lower position as shown in FIG. 19. The catch member is movable inwardly to release the carrier 3 by means of a push button 43 on the outer end of the leg 37*a*. The handle portion 2 and the tubular sleeve 4 of the carrier 3 are suitably slotted to accommodate the stud 35 and the barrel 38 of the catch.

Figure 21:
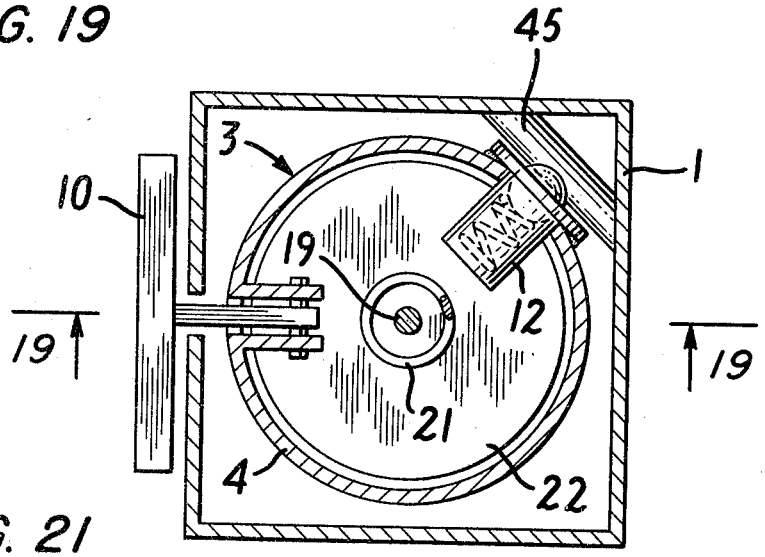
FIG. 21 is a cross section corresponding to FIG. 7 but showing a modification.

When the catch 37 is pushed inwardly by means of the push button 43, the carrier 3 is projected upwardly by the force of the spring 36 applied to the disc 22. The spring 36 is in the nature of a mouse trap spring and is sufficiently strong to give the carrier 3 a vigorous push whereby it is propelled to its upper position as shown in FIG. 1. As the carrier moves upwardly, the portions 2*g* of the handle portion 2 engage the spring catches 30 to push them inwardly and thereby release the outer sections 3*b* of the rib upwardly so that when the carrier 3 reaches its upper position the ribs are fully extended. The rib carrier is releasably retained in its upper position by the bullet-type latch 12. However, in this instance the latch 12 is arranged on a diagonal of the shaft 1 and when the rib carrier is in its upper position, the latch engages a round cross bar 45 provided in an upper portion of the shaft 1 as illustrated in FIG. 21. If desired, a second latch 12 and a second bar 45 may be provided diagonally opposite those shown in FIG. 21. When it is desired to close the umbrella, the rib carrier 3 is moved downwardly in the shaft 1 by means of the knob 10, the ribs are pushed down into the shaft 1 and the handle portion 2 is pushed up into the shaft all as described above. In the last portion of its downward travel, the carrer 3 (by means of the disc 22) engages the spring 36 so as to "cock" the spring. When the rib carrier 3 reaches its lowermost position it is retained by the catch 37.

Figure 20:
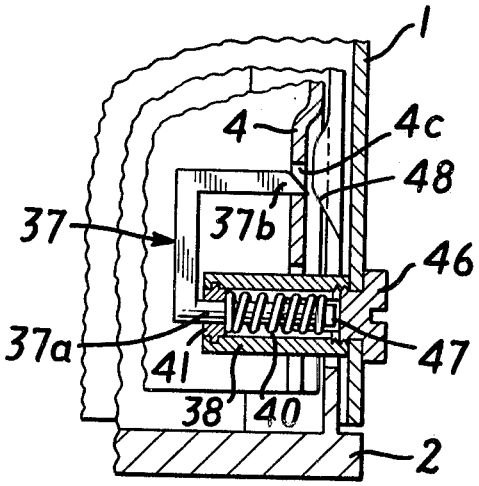
FIG. 20 is a detail showing of a modification of catch means shown in FIG. 19.

FIG. 20 shows a modification of the catch 37. The barrel 38 of the catch is secured to the shaft 1 by a screw plug 46. The push-button 43 is eliminated and the catch is released by engagement of a cross bar 47 by inclined cam portions 48 on the handle portion 2. When the handle portion 2 is pulled downwardly, cam portions 48 engage opposite ends of the cross bar 47 to move the catch inwardly and thereby release the rib carrier. The cross bar 47 slides in diametrically opposite slots in the barrel 38 thereby holding the catch member from rotation. Except for the manner in which the catch is released, the operation is the same as described in connection with FIG. 19.

While preferred embodiments of the invention have been illustrated in the drawings and are herein particularly described, it will be understood that many variations and modifications are possible and that the invention is thus in no way limited to the illustrated embodiments.

What is claimed is:

1. An umbrella comprising an elongate tubular shaft having upper and lower ends and a longitudinally extending slot between said ends, rib carrier means movable longitudinally in said shaft, a plurality of elongate ribs having inner and outer ends, means pivotally connecting said ribs near their inner ends to said rib carrier means, means fixed to said rib carrier means and projecting out through said slot in said shaft for moving said rib carrier means between a closed position in which said rib carrier means is near the lower end of said shaft and said ribs are in said shaft and an open position in which said rib carrier means is near the upper end of said shaft and said ribs radiate from said rib carrier means, latch means for releasably securing said rib carrier means selectively in said open and closed positions, means for retaining said ribs approximately normal to said shaft when in open position, a flexible cover secured at its center to said rib carrier means and at its periphery to outer ends of said ribs, said cover overlying and being supported by said ribs when in open position and being drawn down into said shaft with said ribs when in closed position, said ribs being telescopically extendible and contractable and having a length when extended greater than the length of said shaft and a length when contracted less than the length of said shaft.

2. An umbrella according to claim 1, in which each of said ribs comprises inner and outer tubular sections telescopically slidable one in the other.

3. An umbrella according to claim 2, comprising spring means in each of said ribs acting between said sections to move them relative to one another in a direction to extend said rib.

4. An umbrella according to claim 3, comprising catch means for releasably retaining said sections in contracted condition of said rib.

5. An umbrella according to claim 4, comprising a handle portion telescopically slidable in a lower end portion of said shaft between a contracted condition in which it is essentially inside said shaft and an extended position in which it forms a downward extension of said shaft, said handle having means for releasing said catch means of said ribs when said handle is moved from contracted to extended position.

6. An umbrella according to claim 1, comprising a handle portion telescopically slidable in a lower end portion of said shaft between a contracted condition in which it is essentially inside said shaft and an extended position in which it forms a downward extension of said shaft.

7. An umbrella according to claim 1, in which said shaft is polygonal with four to eight sides and in which the number of ribs is equal to the number of sides of said shaft, said ribs when in said shaft being disposed in respective corners of said shaft.

8. An umbrella according to claim 1, in which said cover is of waterproof two-way stretch material.

9. An umbrella according to claim 8, in which the material of said cover has at least 20% stretch with 100% recovery.

10. An umbrella according to claim 8, in which said cover has at its periphery inwardly opening pockets in which outer ends of said ribs are removably received, and in which means for securing said cover at its center to said rib carrier means is user-releasable, whereby said cover is user-removable and user-replaceable.

11. An umbrella according to claim 8, in which said cover is of one-piece construction.

12. An umbrella according to claim 1, comprising enlarged tip portions removably secured on outer ends of said ribs, said tip portions having surfaces which together form a closure for the upper end of said shaft when said ribs are in said shaft in closed position.

13. An umbrella according to claim 1, further comprising spring means for propelling said rib carrier means from closed position to open position, catch means for retaining said rib carrier means in closed position and means for releasing said catch means, whereupon said rib carrier means is propelled by said spring means from closed position to open position.

14. An umbrella having a frame comprising a shaft, a plurality of substantially straight pivoted ribs and means for moving said ribs between a closed position in which they extend longitudinally of said shaft and an open position in which they radiate from an upper end portion of said shaft, a cover of water-proof two-way stretch material having a two-way stretch of at least 20% with 100% recovery, and means at the periphery of said cover for attaching said cover at its periphery to outer ends of said ribs, said cover having an area in relaxed condition of said material which is less than 70% of the area of said cover on said umbrella when said ribs are in open position, and thus being held in stretched condition by said ribs when in open position, said ribs being sufficiently rigid to remain substantially straight in both open and closed position, and said means for attaching said cover at its periphery to outer ends of said ribs comprising peripheral portions of said cover forming inwardly opening pockets which removably receive tip portions of said ribs and are removably held on said tip portions by the tendency of said stretched fabric to contract.

15. An umbrella according to claim 14, in which said cover is of waterproof two-way stretch material having a two-way stretch of at least 50%, with 100% recovery, said cover having an area in relaxed condition which is less than half the area of said cover on said umbrella when said ribs are in open position.

16. An umbrella according to claim 14, in which said material of said cover has a stretch of at least 100% with 100% recovery.

17. An umbrella according to claim 14, 15 or 16 in which said cover is of one-piece construction.

18. An umbrella according to claim 14, in which said ribs are tubular and tip portions of said ribs received in said pockets are flattened.

19. An umbrella comprising an elongate tubular shaft having upper and lower ends and a longitudinally extending slot between said ends, rib carrier means movable longitudinally in said shaft, a plurality of elongate ribs having inner and outer ends, means pivotally connecting said ribs near their inner ends to said rib carrier means, means fixed to said rib carrier means and projecting out through said slot in said shaft for moving said rib carrier means between a closed position in which said rib carrier means is near the lower end of said shaft and said ribs are in said shaft and an open position in which said rib carrier means is near the upper end of said shaft and said ribs radiate from said rib carrier means, latch means for releasably securing said rib carrier means selectively in said open and closed positions, means for retaining said ribs approximately normal to said shaft when in open position, and a flexible cover secured at its center to said rib carrier means and at its periphery to outer ends of said ribs, said cover overlying and being supported by said ribs when in open position and being drawn down into said shaft with ribs when in closed position, said shaft being polygonal with four to eight sides and the number of said ribs being equal to the number of sides of said shaft, said ribs when in said shaft being disposed at respective corners of said shaft.

20. An umbrella according to claim 19, in which an upper end portion of said shaft is slotted with slots at the corners of said shaft, inner end portions of said ribs being received in said slots when said ribs are in open position.

21. An umbrella comprising an elongated tubular shaft having upper and lower ends and a longitudinally extending slot between said ends, rib carrier means movable longitudinally in said shaft, a plurality of elongate ribs having inner and outer ends, means pivotally connecting said ribs near their inner ends to said rib carrier means, a flexible cover secured at its center to said rib carrier means and at its periphery to outer ends of said ribs, said rib carrier means being movable longitudinally in said shaft between a closed position in which said carrier means is near the lower end of said shaft and said ribs and cover are in said shaft and an open position in which said carrier means is near the upper end of said shaft, said ribs radiate from said rib carrier means and said cover is supported in open position by said ribs, means fixed to said rib carrier means and projecting out through said slot in said shaft for manually moving said rib carrier means longitudinally of said shaft, releasable catch means for holding said rib carrier means in closed position, means for manually releasing said catch means, and spring means acting on said rib carrier means to propel said rib carrier means from closed toward open position upon release of said catch means.

22. An umbrella according to claim 21, in which said catch releasing means comprises a manually operable push button near the lower end of said shaft.

23. An umbrella according to claim 21, further comprising an extensible handle portion telescopically slidable in a lower portion of said shaft, said catch releasing means comprising means on said handle portion operable to release said catch means when said handle portion is moved downwardly relative to said shaft.

* * * * *